US007964094B2

(12) United States Patent
Sudholt et al.

(10) Patent No.: US 7,964,094 B2
(45) Date of Patent: Jun. 21, 2011

(54) FILTRATION AND RECOVERY SYSTEM

(75) Inventors: Todd Sudholt, Aviston, IL (US); Daniel Sims, Trenton, NJ (US)

(73) Assignee: Jim's Formal Wear Co., Trenton, IL (US)

( * ) Notice: Subject to any disclaimer, the term of this patent is extended or adjusted under 35 U.S.C. 154(b) by 1190 days.

(21) Appl. No.: 11/654,835

(22) Filed: Jan. 18, 2007

(65) Prior Publication Data

US 2007/0170120 A1 Jul. 26, 2007

Related U.S. Application Data

(60) Provisional application No. 60/759,710, filed on Jan. 18, 2006.

(51) Int. Cl.
*D06F 39/10* (2006.01)

(52) U.S. Cl. ... 210/138; 210/142; 210/143; 210/167.01; 210/167.31; 210/172.1; 210/195.1; 210/248; 210/251; 210/255; 210/262; 210/297; 210/331; 210/332; 210/345; 210/359; 210/391; 210/407; 68/18 F; 134/111; 8/141; 8/142

(58) Field of Classification Search ..... None
See application file for complete search history.

(56) References Cited

U.S. PATENT DOCUMENTS 2,593,707 A * 4/1952 Walker ..... 210/359
2,705,221 A * 3/1955 Clark et al. ..... 204/662
3,055,290 A * 9/1962 Arvanitakis ..... 100/116
3,157,598 A * 11/1964 Rebiscoul ..... 210/327
3,232,081 A * 2/1966 Severance et al. ..... 68/18 R
3,316,055 A * 4/1967 Moncada et al. ..... 8/142
3,438,497 A * 4/1969 Maestrelli ..... 210/791
3,497,452 A * 2/1970 Arvanitakis ..... 210/663
3,503,878 A * 3/1970 Durr ..... 210/664
3,672,958 A * 6/1972 McCandlish ..... 202/170
3,907,681 A * 9/1975 Corrigan et al. ..... 210/777
4,279,704 A * 7/1981 Noble et al. ..... 202/175
4,320,002 A * 3/1982 Ihara ..... 210/178
4,626,351 A * 12/1986 Fuhring ..... 210/331
4,879,888 A * 11/1989 Suissa ..... 68/18 C
4,885,099 A * 12/1989 Kelly ..... 210/771
5,047,123 A * 9/1991 Arvanitakis ..... 202/170
5,205,910 A * 4/1993 Arbizzani et al. ..... 202/175
5,228,987 A * 7/1993 Arvanitakis ..... 210/182
5,620,598 A * 4/1997 Strid ..... 210/324
6,474,111 B1 * 11/2002 Pattee ..... 68/18 F
7,210,182 B2 * 5/2007 Fyvie et al. ..... 8/158
(Continued)

*Primary Examiner* — Robert James Popovics
(74) *Attorney, Agent, or Firm* — Peter S. Gilster; Greensfelder, Hemker & Gale, P.C.

(57) ABSTRACT

A solvent filtration and recovery system for filtration and recovery of a solvent-based liquid used in dry cleaning includes filtration tank having filter chamber with motor-driven spin filters which are selectively operated. A valve and conduit arrangement allows the liquid from dry cleaning to enter the filter chamber for filtering and flows out as filtered liquid while the spin filters are not rotating. The arrangement allows initial at least partial draining of the solvent-based liquid in the filter chamber after such filtration procedure. A recovery tank is in communication with the filtration tank through a main drain. A motor drives the spin filters during a recovery procedure, in which centrifugal force caused by the rotating spin filters for a predetermined amount of time removes by-product from the spin filters, which is drained off from the filtration tank. A reservoir stores the solvent-based liquid and receives the liquid from both the recovery tank and the filtration tank. Operation is microprocessor implemented and controlled.

11 Claims, 5 Drawing Sheets

U.S. PATENT DOCUMENTS

| | | | | |
|---|---|---|---|---|
| 7,356,865 | B2 * | 4/2008 | Rawson et al. | 8/149 |
| 7,603,878 | B2 * | 10/2009 | Fyvie | 68/18 R |
| 7,681,419 | B2 * | 3/2010 | Naber et al. | 68/18 F |
| 2006/0169624 | A1 * | 8/2006 | Radomyselski et al. | 210/96.1 |
| 2007/0170120 | A1 * | 7/2007 | Sudholt et al. | 210/739 |

* cited by examiner

FILTRATION AND RECOVERY SYSTEM

CROSS-REFERENCE TO RELATED APPLICATION

This application is based on and claims the priority of U.S. Provisional Patent Application Ser. No. 60/759,710, entitled FILTRATION AND RECOVERY SYSTEM, of the present inventors Todd Sudholt and Daniel Sims, having a filing date of Jan. 18, 2006, which is incorporated herein in its entirety by reference.

FIELD

The present document relates to a filtration and recovery system for a solvent-based liquid.

SUMMARY

In an embodiment, a filtration and recovery system may comprise a filtration tank, the filtration tank defining a filter chamber in fluid flow communication with a first opening for the ingress of a solvent-based liquid and the egress of a by-product, a second opening for initial draining of the solvent-based liquid, and a third opening for the egress of the solvent-based liquid, the filtration tank having a plurality of filters for filtering the solvent-based liquid in a filtration procedure, the plurality of filters being adapted to accumulate the by-product during the filtration procedure, and a recovery tank in fluid flow communication with the filtration tank through a main drain in communication with the first opening and an auxiliary drain in communication with the second opening, the recovery tank including a front portion and a back portion defining a slanted surface, the slanted surface in communication with a filter portion having a secondary filter for filtering the by-product, wherein the filtration tank and the recovery tank establish a non-pressurized system for the movement of the by-product.

Additional features will be set forth in the description which follows or will become apparent to those skilled in the art upon examination of the drawings and detailed description which follows.

BRIEF DESCRIPTION OF THE DRAWINGS

Corresponding reference characters indicate corresponding elements among the view of the drawings.

DETAILED DESCRIPTION

Figure 1:
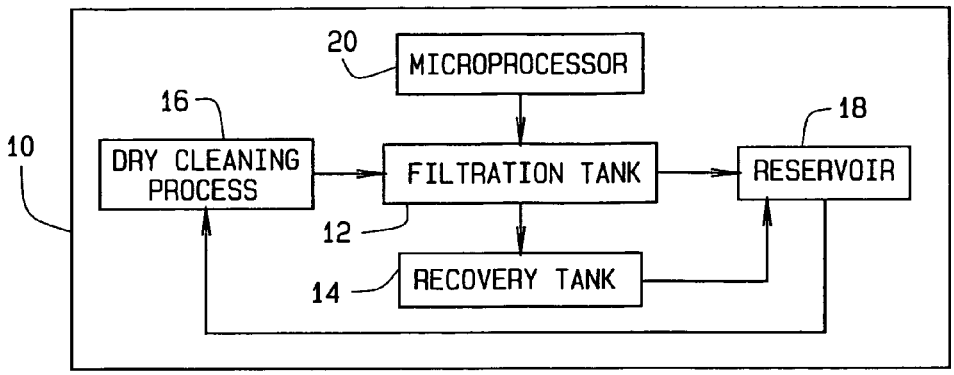
FIG. 1 is a simplified block diagram showing a filtration and recovery system.

Referring to the drawings, an embodiment of filtration and recovery system is illustrated and generally indicated as 10 in FIG. 1. The filtration and recovery system 10 may include a filtration tank 12 for conducting a filtration procedure that filters a solvent-based liquid (not shown) used in a dry cleaning process 16. In one embodiment, the dry cleaning process 16 may utilize a single dry cleaning machine (not shown) with the filtration and recovery system 10, although in other embodiments the dry cleaning process 16 may include a plurality of dry cleaning machines. In another embodiment, the filtration and recovery system 10 may filter any type of solvent-based liquid used for other types of processes other than the dry cleaning process 16.

The filtration tank 12 may be in fluid flow communication with a recovery tank 14 for recovering solvent-based liquid contained in a by-product that is produced in the filtration tank 12 during the filtration procedure as shall be discussed in greater detail below. In addition, the filtration tank 12 and recovery tank 14 are in fluid flow communication with a reservoir 18 that stores solvent-based liquid filtered during the filtration procedure or recovered from the by-product inside the recovery tank 14 during a recovery procedure as shall also be discussed in greater detail below.

As shown, the filtration and recovery system 10 may include a microprocessor 20 for controlling the filtration and recovery procedures. The microprocessor 20 may be operatively associated with a multi valve arrangement having a first valve 50, second valve 52 and third valve 54 for controlling the flow of the solvent-based liquid as well as the flow of by-product during operation of the filtration and recovery system 10. In one embodiment, first, second and third valves 50, 52 and 54 may be hydraulic or air pressure valves for permitting or preventing fluid flow communication.

Referring to FIGS. 2-7, filtration tank 12 may define a filter chamber 30 in communication with a first opening 42 adapted for the ingress of the solvent-based liquid into the filter chamber 30 during the filtration procedure as well as egress of by-product from the filter chamber 30 during the recovery procedure. The filter chamber 30 also communicates with a second opening 43 for allowing the solvent-based liquid to be initially drained during the recovery procedure. As shown, first opening 42 communicates with a conduit 88 that is engaged to a coupling 86, such as a conventional Tee, that permits either the entry of solvent-based liquid used during the filtration procedure or the removal of by-product from the filter chamber 30 during the recovery procedure. The first valve 50 may communicate with the coupling 86 which is operable between an open position, wherein solvent-based liquid used during the dry cleaning process 16 is allowed to enter the filtration tank 12 and a closed position, wherein solvent-based liquid is prevented from entering the filtration tank 12.

The coupling 86 may also communicate with a main drain 22 through second valve 52 that allows by-product to be removed from the filtration chamber 30 during the recovery procedure. Second valve 52 may be operable between an open position, wherein by-product may enter the main drain 22 for entry into the recovery tank 14 during the recovery procedure and a closed position, wherein the solvent-based liquid is prevented from entering the main drain 22 during the filtration procedure.

As shown, second opening 43 is in selective fluid flow communication with an auxiliary drain 24 through the third valve 54. Third valve 54 is operable between an open position, wherein solvent-based liquid inside the filter chamber 30 can be initially drained during the first phase of the recovery procedure to a level where the second opening 43 communicates with the filter chamber 30.

As further shown, a plurality of spin filters 26 are operatively disposed inside the filter chamber 30 for filtering the solvent-based liquid of by-product, such as dirt, grease, particulates, fibers and other materials that may become entrained in the solvent-based liquid during the dry cleaning process 16. The plurality of spin filters 26 may be mounted on a hollow tubular member 38 which extends along the axis of the filtration tank 12 and defines a conduit 78 in communication with a third opening 45 for permitting solvent-based liquid to exit the filtration tank 12 after filtration and return to the reservoir 18. In one embodiment, the hollow tubular member 38 defines a plurality of openings 76 in communication with a respective spin filter 26 mounted by a collar (not shown) such that solvent-based liquid that has been filtered by each spin filter 26 enters the conduit 78 of the tubular member 38 and exits third opening 45 for storage in the reservoir 18.

As a result of this filtration procedure, by-product can accumulate on the spin filters 26 over time. The filtration tank 12 may include a motor 34 in operative engagement with one end of the tubular member 38 through a gear assembly 46 that rotates the mounted spin filters 26 in a spinning motion when directed by microprocessor 20. This spinning motion dislodges and removes the by-product that has accumulated on the spin filters 26 due to the centrifugal force generated by the spinning motion of the spin filters 26. The by-product then falls by force of gravity after removal from the spin filters 26 to the bottom portion of the filter chamber 30. When first valve 50 is in the closed position and second valve 52 is in the open position during the recovery procedure, the by-product can be channeled through first opening 42 and into main drain 22 such that the by-product can enter the recovery tank 14 for the recovery of solvent-based liquid contained in the by-product.

Figure 4:
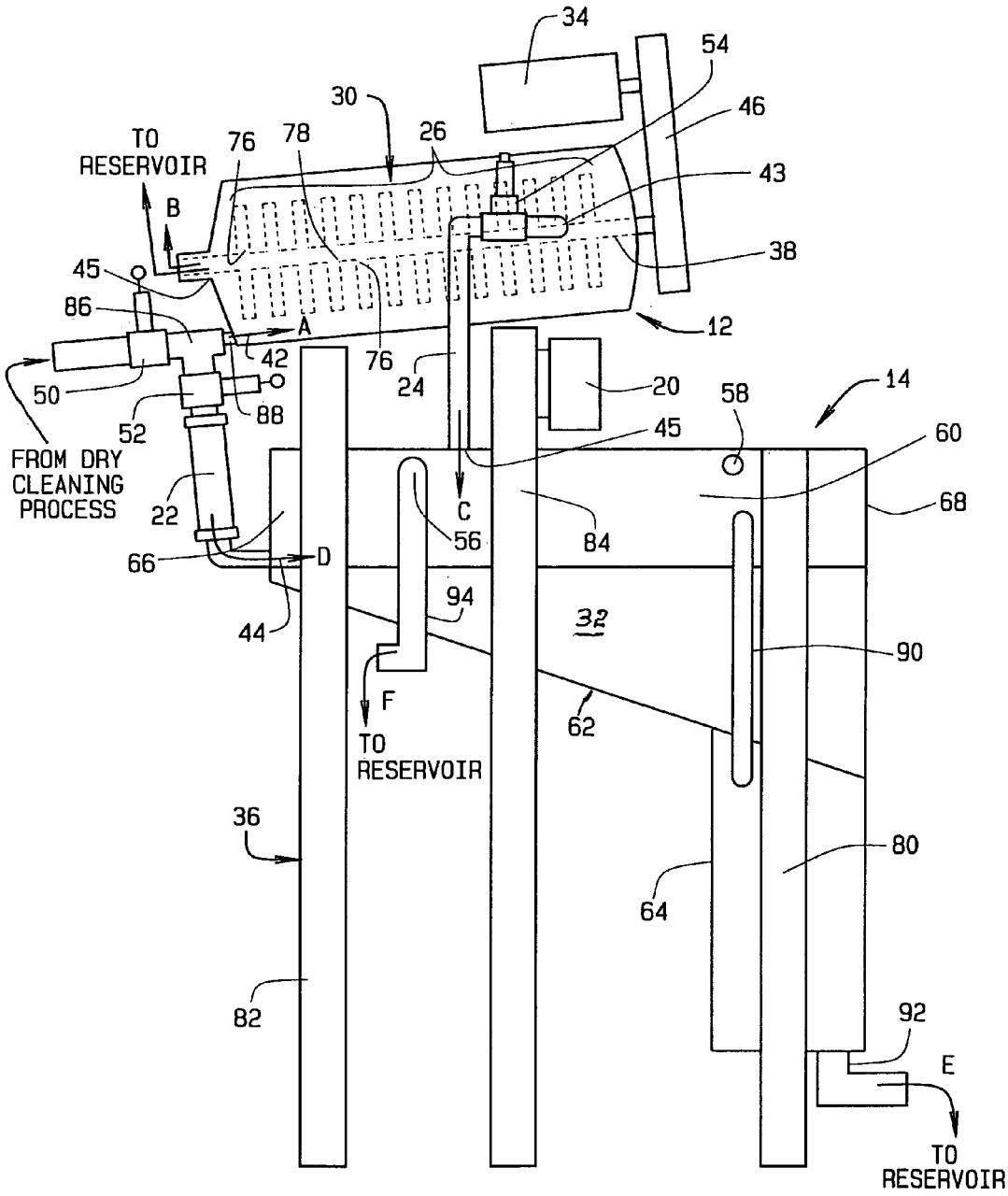
FIG. 4 is a simplified partial cross-sectional side view of the filtration and recovery system.
Figure 6:
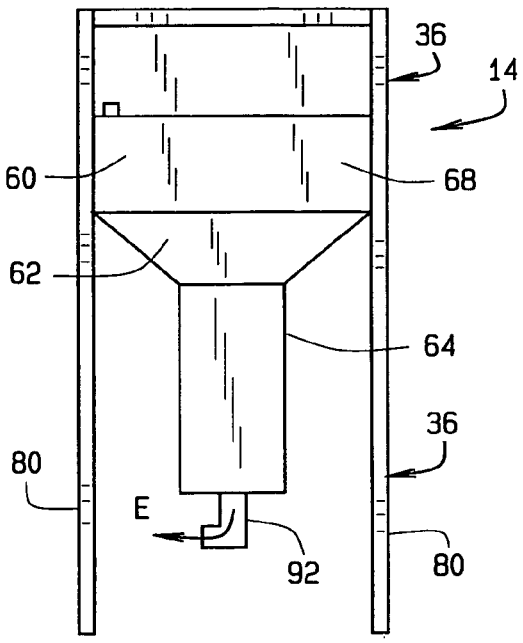
FIG. 6 is a front view of the recovery tank.

Referring to FIG. 4, recovery tank 14 may define a recovery chamber 32 that includes an inlet 44 in communication with main drain 22 for the entry of by-product removed from the filtration tank 12 during the recovery procedure. In addition, the recovery tank 14 may define a back portion 66 and a front portion 68 in communication with an upper portion 60 and a lower portion 62. The lower portion 62 may define a slanted surface 72 that slants downwardly from the back portion 66 to the front portion 68 such that the slanted surface 72 terminates at a filter portion 64 located below the front portion 68.

In one embodiment, the slanted surface 72 may have a vertical drop of 6 inches from the front portion 68 to the back portion 66, however it is contemplated that the slanted portion 72 may be set at any angle sufficient to permit by-product that enters inlet 44 to flow downwardly along slanted surface 72 by the force of gravity alone in a non-pressurized system during the recovery procedure.

As further shown, the upper portion 60 may define an overflow opening 56 in communication with a tubular member 94 adapted to permit the overflow of by-product inside the recovery chamber 32 to drain from the recovery tank 14 and into the reservoir 18. In addition, the upper portion 60 may define a wash down opening 58 adapted to permit entry of a hose for washing down the recovery chamber 32 of residual by-product.

Figure 2:
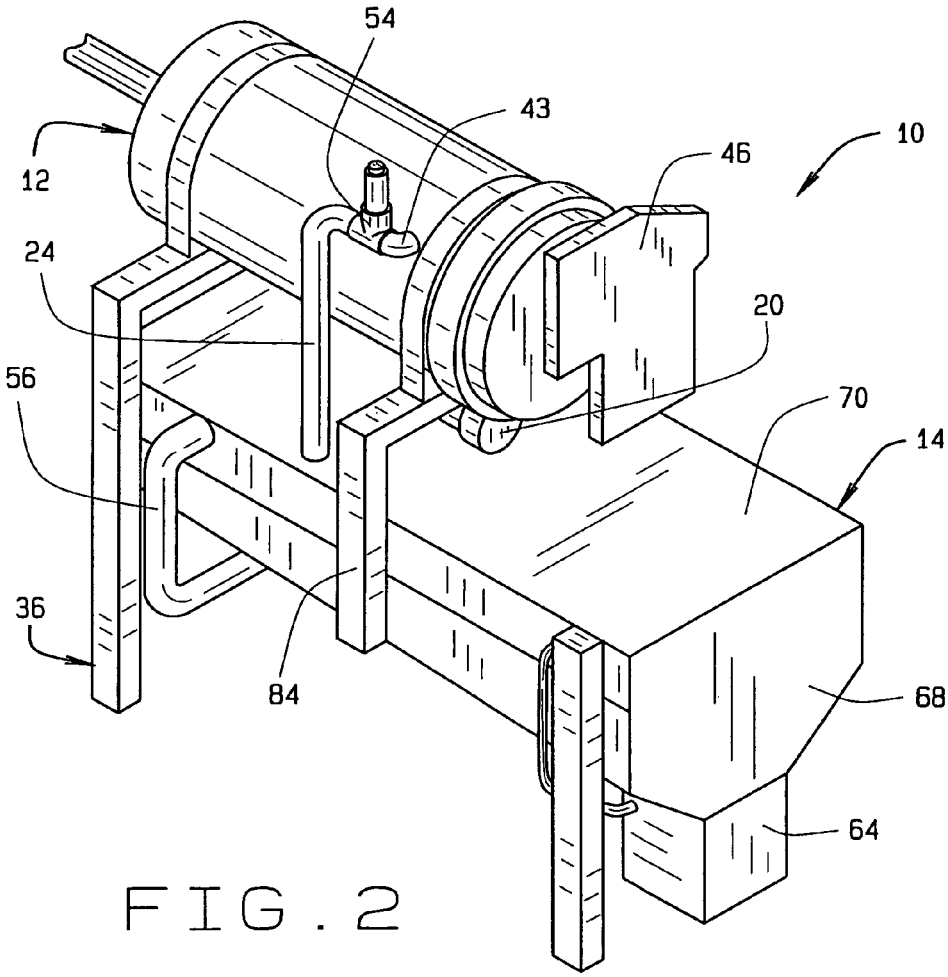
FIG. 2 is a perspective view of the filtration and recovery system.
Figure 3:
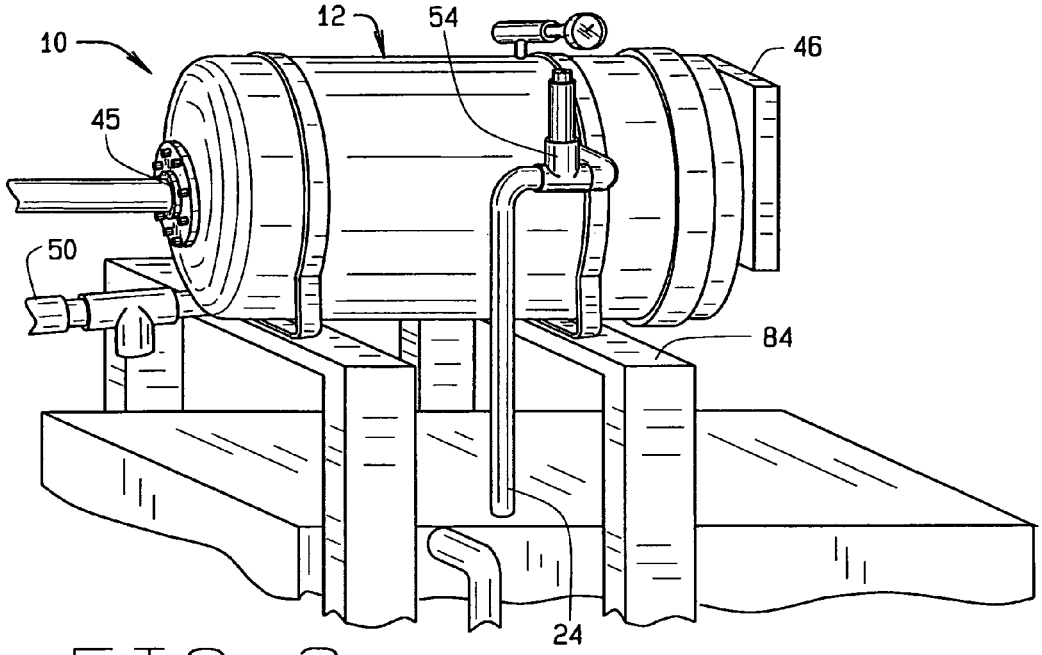
FIG. 3 is another perspective view of the filtration and recovery system.
Figure 5:
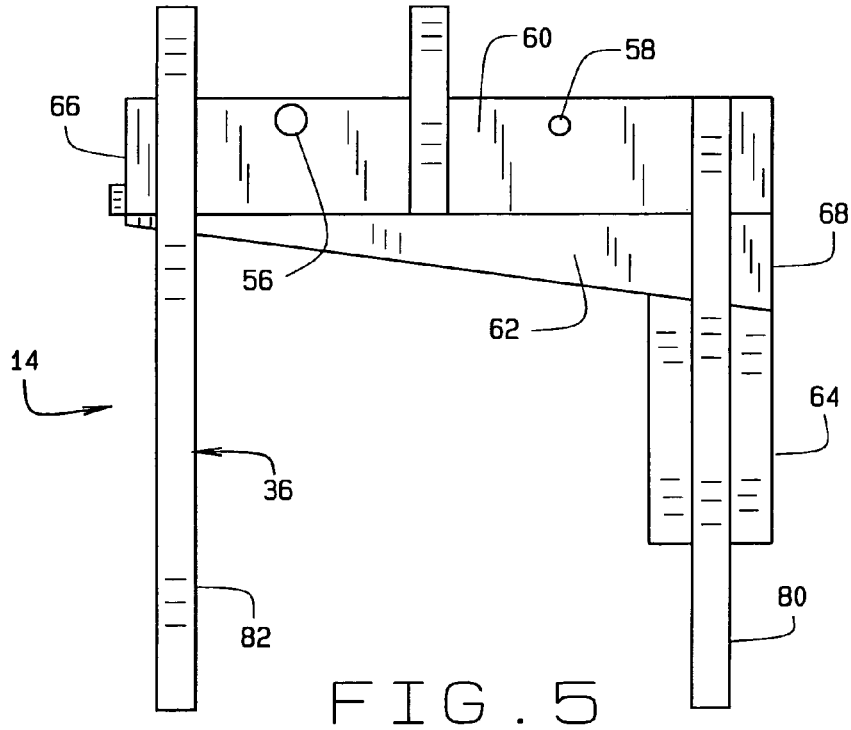
FIG. 5 is a side view of a recovery tank of the filtration and recovery system.

Referring to FIG. 2, the inlet 44 may communicate with the front portion 68 such that any by-product that enters inlet 44 from the main drain 22 is channeled downwardly by the force of gravity along the slanted portion 72 such that the by-product enters the filter portion 64. The filter portion 62 may include a detachable secondary filter 28 adapted to filter the by-product such that solvent-based liquid contained in the by-product may be recovered and stored in reservoir 18. In addition, a vent tube 90 may be provided that has an upper end 96 in communication with front portion 68 and a lower end 98 in communication with the filter portion 64. The vent tube 90 is adapted to permit equalization of pressure between the front portion 68 and the filter portion 64 of the recovery chamber 32 during the recovery procedure.

Figure 7:
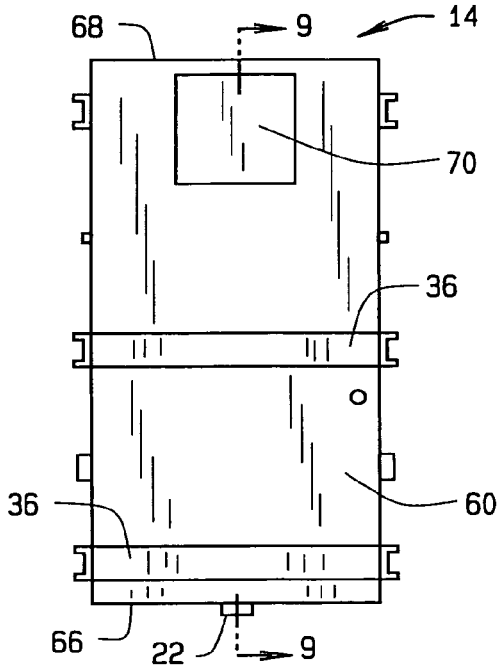
FIG. 7 is a top view of the recovery tank.
Figure 8:
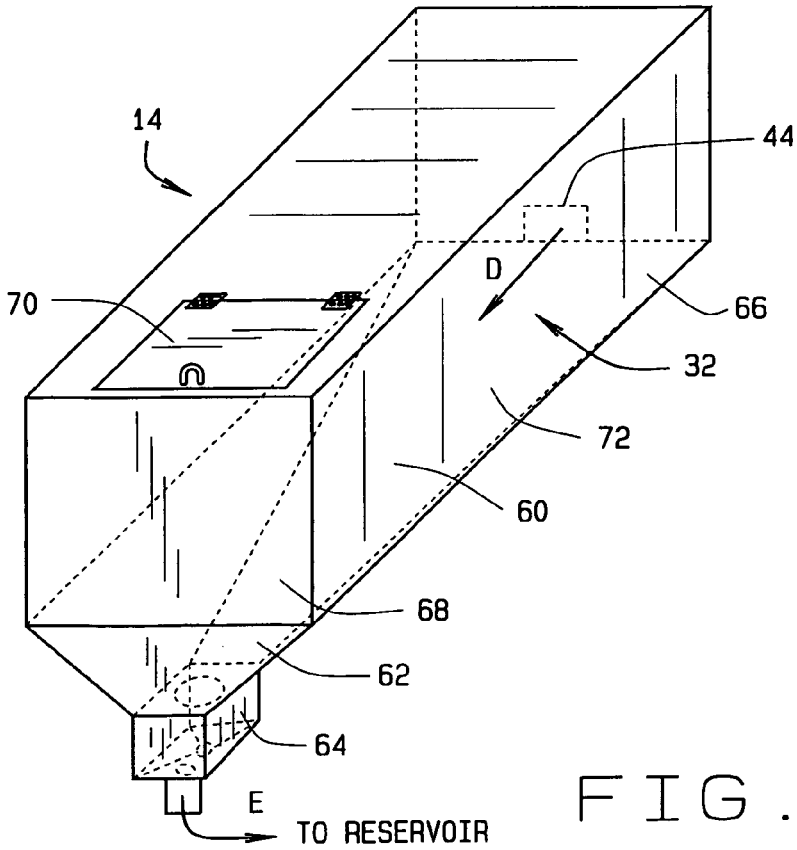
FIG. 8 is a perspective view of the recovery tank shown in partial phantom lines.
Figure 9:
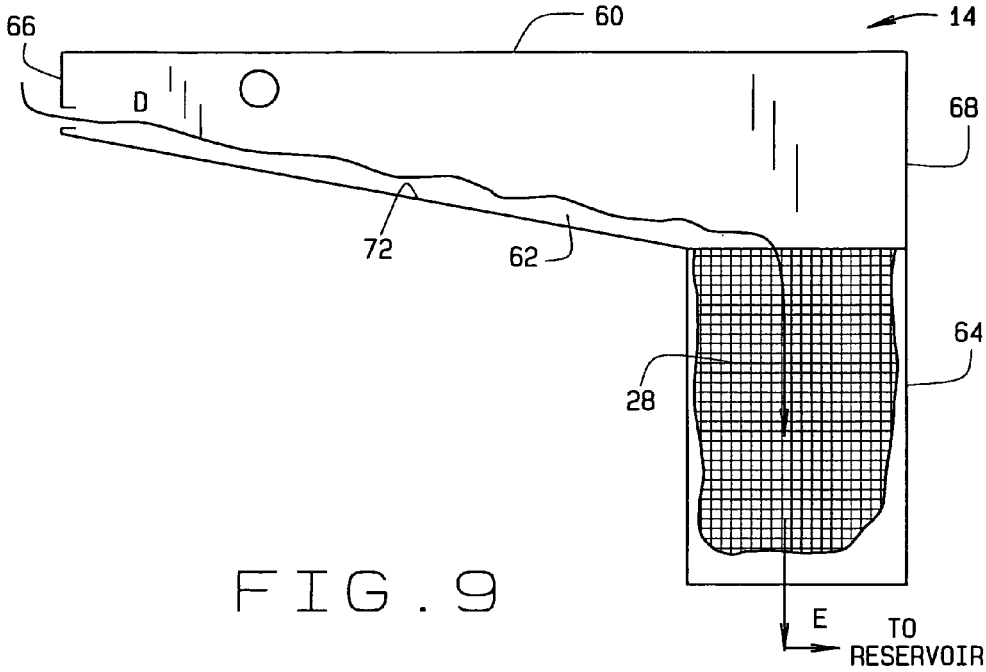
FIG. 9 is a cross-sectional view of the recovery tank taken along line 9-9 of FIG. 7 illustrating the direction of flow into a secondary filter disposed inside the recovery tank.

In one embodiment, the detachable secondary filter 28 may be a filter basket made from a material adapted to permit solvent-based liquid to filter through while retaining residual by-product within the filter basket which may then be later removed from the filter portion 64 in order to dispose of the residual by-product. Referring to FIG. 7, the upper portion 60 of the recovery tank 14 may include a door 70 that permits access to the recovery chamber 32 so that the detachable secondary filter 28 may be removed as noted above.

The filtration tank 12 and recovery tank 14 may be engaged to a support 36 in order to provide a structural base for the filtration and recovery system 10. As shown, the support 36 may have a pair of front legs 80 and a pair of back legs 82 for supporting the recovery tank 14. The support 36 may further include a pair of upper legs 84 engaged to the recovery tank 14 which, in combination with the back legs 82, support the filtration tank 12 such that the tank 12 is angled downwardly towards the rear legs 84 as illustrated in FIG. 4. This downward orientation of the filtration tank 12 permits the by-product to be evacuated by force of gravity alone from the bottom portion of the filter chamber 30 and into the recovery tank 14 through the main drain 22.

Figure 10:
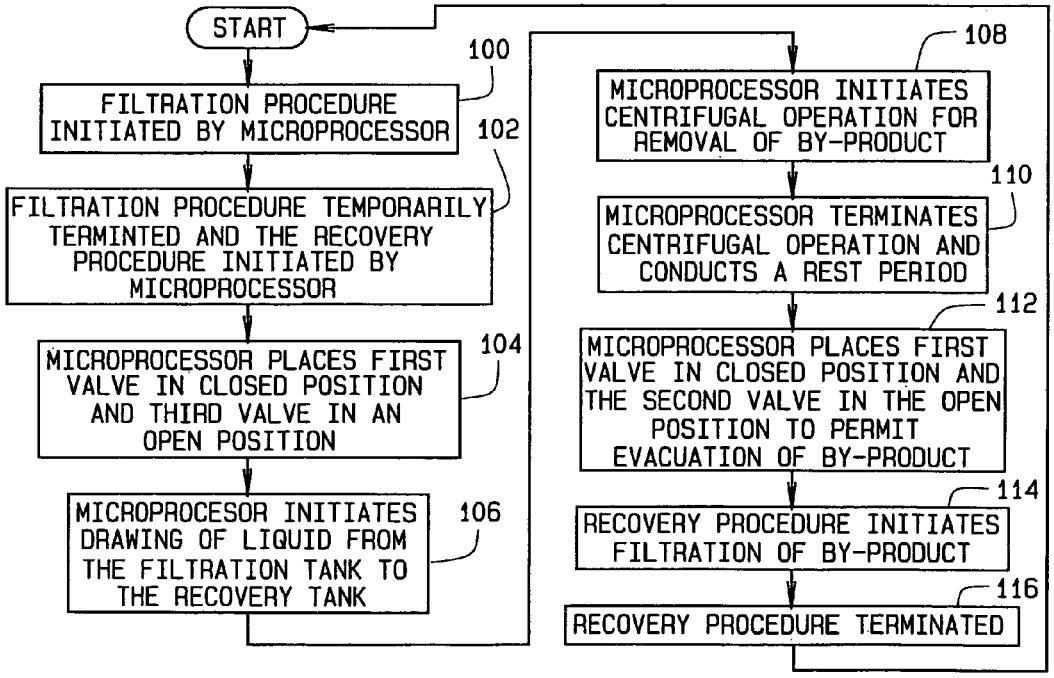
FIG. 10 is flow chart illustrating the operation of the filtration and recovery system.

Referring to FIGS. 4, 8-10, the method of operation for the filtration and recovery system 10 will be discussed in greater detail. As shown in FIG. 10, at step 100 the filtration procedure is initiated such that the microprocessor 20 places first valve 50 in an open position in order to permit solvent-based liquid used in the dry cleaning process 16 to enter the filtration tank 12 through first opening 42, while second valve 52 and third valve 54 are placed in the closed position in order to prevent solvent-based liquid from entering the recovery tank 14. During the filtration procedure solvent-based liquid from the dry cleaning process 16 flows into the filtration tank 12 through first opening 42, as illustrated by flow A, and fills the filter chamber 30 such that solvent-based liquid enters and is filtered by the spin filters 26 and exits third opening 45, as illustrated by flow B, such that filtered solvent-based liquid enters reservoir 18.

After a predetermined period of time has expired, the filtration procedure is temporarily terminated by the microprocessor 20 and the recovery procedure may then be initiated by turning off the pump (not shown) that drives the solvent-based liquid from the dry cleaning machine(s) during the dry cleaning process 16 at step 102. The microprocessor 20 at step 104 then places first valve 50 in the closed position in order to prevent any further solvent-based liquid from entering the filtration tank 12 as well as placing third valve 54 in the open position in order to allow the solvent-based liquid inside filter chamber 30 to be initially drained from the filtration tank 12.

At step 106, the solvent-based liquid is allowed to drain through the auxiliary drain 24 as illustrated by flow C and into the recovery tank 14 until the solvent-based liquid reaches the level of the second opening 43 inside the filter chamber 30. Once the filtration tank 12 is sufficiently drained, the microprocessor 20 at step 108 engages the motor 34 with the gear assembly 46 such that the tubular member 38 is rotated in one direction in a centrifugal operation that removes by-product from the plurality of spin filters 26 for a predetermined amount of time. In one embodiment, the centrifugal operation is conducted for 15 seconds and then terminated for 15 seconds over a period of 3 minutes; however, other predetermined periods of time for cycling the centrifugal operation are contemplated.

This centrifugal operation agitates the spin filters 26 such that by-product is removed and allowed to accumulate at the bottom of the filter chamber 30. In one embodiment, the centrifugal operation may rotate in one direction during one cycle and then rotate in the opposite direction in the next cycle in order to remove by-product from the spin filters 26.

After the centrifugal operation is completed, at step 110 a rest period, for example 10-15 seconds, is conducted. At step 112, the microprocessor 20 may then place second valve 52 in the open position, while first valve 50 remains in the closed position and third valve 54 remains in the open position. This valve arrangement permits the by-product accumulated along the bottom portion of the filter chamber 30 to be evacuated through the main drain 24 and into the recovery tank by force of gravity as illustrated by flow D.

At step 114, the recovery procedure is initiated for recovery of solvent-based liquid from the by-product. During the recovery procedure, the by-product contacts the slanted portion 72 upon entering the recovery chamber 32 of the recovery tank 14 through the inlet 44 and is channeled toward the filter portion 64 in a gravity feed movement. As by-product is channeled towards the filter portion 64 the by-product enters the secondary filter 28 for filtration. During the recovery procedure, by-product accumulates in the secondary filter 28 inside the filter portion 64 so that any solvent-based liquid contained in the by-product is filtered through the secondary filter 28 and may exit through a filter outlet 92 located at the bottom of the filter portion 64 as illustrated by flow E. After exiting the filter outlet 92, the solvent-based liquid is transported to the reservoir 18 for use in the dry cleaning process 16. In one embodiment, by-product may be allowed to exit the filtration tank 12 and enter the recovery tank 14 for 30 seconds, although other times are contemplated. After the recovery procedure is completed, at step 116, the microprocessor 20 places the second valve 52 and the third valve 54 in the closed position, while placing the first valve 50 in the open position in order to once again initiate the filtration procedure as noted above.

Once a sufficient amount of by-product has accumulated in the secondary filter 28, secondary filter 28 with the accumulated by-product therein may be removed through the door 70 of the recovery tank 14. The secondary filter 28 may then be inserted back into the filter portion 64 for further filtering of by-product from the filtration tank 12.

It should be understood from the foregoing that, while particular embodiments have been illustrated and described, various modifications can be made thereto without departing from the spirit and scope of the invention as will be apparent to those skilled in the art. Such changes and modifications are within the scope and teaching of this invention as defined in the claims appended hereto.

What is claimed is:

1. A solvent filtration and recovery system for filtration and recovery of a solvent-based liquid used in dry cleaning, said system comprising:

a filtration tank, the filtration tank defining a filter chamber, the filter chamber being in fluid flow communication with at least one first opening of the filter chamber for ingress of a solvent-based liquid and egress of a by-product, at least one second opening of the filter chamber for initial draining of the solvent-based liquid, and at least one third opening of the filter chamber for egress of the solvent-based liquid, the filtration tank having a plurality of filters for filtering the solvent-based liquid in a filtration procedure, the plurality of filters being adapted to accumulate the by-product during the filtration procedure, and a recovery tank in fluid flow communication with the filtration tank through a main drain in communication with the first opening and an auxiliary drain in communication with the second opening, the recovery tank including a front portion and a back portion defining a slanted surface, the slanted surface in communication with a filter portion having a secondary filter for filtering the by-product, a reservoir for storing the solvent-based liquid and for receiving said liquid from both the recovery tank and from the filtration tank, wherein the filtration tank and the recovery tank establish a non-pressurized system for the movement of the by-product and filtration of the solvent-based liquid.

2. The system of claim 1 wherein the plurality of filters inside the filtration tank comprise a plurality of spin filters operatively disposed inside the filter chambers.

3. The system of claim 2 wherein the spin filters are mounted on a driven rotational tubular member which extends along an axis of elongation of the filtration tank and which tubular member defines a conduit communicating with the at least one third opening for permitting solvent-based liquid to exit the filtration tank after filtration and to return to the reservoir.

4. The system of claim 3 wherein the hollow tubular is driven by a motor when the motor is engaged.

5. The system of claim 4 wherein the system comprises a microprocessor for controlling engagement of the motor and for controlling filtration and recovery procedures.

6. The system of claim 5 wherein the microprocessor is operatively associated with a multi valve arrangement having at least a first valve, a second valve, and a third valve for controlling the flow of the solvent-based liquid as well as the flow of by-product during operation of the filtration and recovery system.

7. The system of claim 6 wherein the at least first, second and third valves are hydraulic or air pressure valves for permitting or preventing fluid flow communication.

8. The system of claim 7 wherein the first valve is in a closed position and the second valve is in the open position during the recovery procedure, the by-product being channeled through the first opening and into a main drain such that the by-product can enter the recovery tank for the recovery of solvent-based liquid contained in the by-product.

9. The system of claim 8 wherein the recovery tank defines a recovery chamber that includes an inlet in communication with the main drain for entry of by-product removed from the filtration tank during the recovery procedure;

the recovery tank defining a back portion and a front portion in communication with an upper portion and a lower portion, the lower portion defining a slanted surface that slants downwardly from the back portion to the front portion such that the slanted surface terminates at a filter portion located below the front portion.

10. The system of claim 3 wherein the hollow tubular member defines a plurality of openings in communication with a respective spin filters mounted such that solvent-based liquid that has been filtered by each spin filter enters a conduit of the tubular member and exits said third opening for storage in the reservoir.

11. The system of claim 3 wherein the hollow tubular member defines a plurality of openings in communication with a respective spin filters, and wherein as a result of filtration by the spin filters, by-product can accumulate on the spin filters over time;

the system further comprising a motor in operative engagement with the tubular member to rotate the spin filters in a spinning motion when activated, and wherein said spinning motion dislodges and removes the by-product that has accumulated on the spin filters due to the centrifugal force generated by the spinning motion of the spin filters;

the by-product falling by force of gravity after removal from the spin filters to a bottom portion of the filter chamber for recovery.

* * * * *